United States Patent [19]

Panetti

[11] 4,115,857

[45] Sep. 19, 1978

[54] PROCESS AND APPARATUS FOR ON-TRACK TRUING OF THE HEADS OF RAILS OF A RAILWAY

[75] Inventor: Romolo Panetti, Geneva, Switzerland

[73] Assignee: Speno International S.A., Geneva, Switzerland

[21] Appl. No.: 768,431

[22] Filed: Feb. 14, 1977

[30] Foreign Application Priority Data

Feb. 18, 1976 [CH] Switzerland ..... 1961/76

[51] Int. Cl.[2] ..... G06F 15/46; B24B 49/10

[52] U.S. Cl. ..... 364/474; 51/178; 364/118

[58] Field of Search ..... 51/178; 364/474, 118, 364/117

[56] References Cited

U.S. PATENT DOCUMENTS

| | | | |
|---|---|---|---|
| 3,738,066 | 6/1973 | Panetti | 51/178 |
| 3,888,052 | 6/1975 | Panetti | 51/178 |
| 3,918,215 | 11/1975 | Scheuchzer | 51/178 |
| 3,945,152 | 3/1976 | Helgemeir | 51/178 |
| 4,020,599 | 5/1977 | Panetti | 51/178 |
| 4,050,196 | 9/1977 | Theurer | 51/178 |

*Primary Examiner*—Felix D. Gruber

*Attorney, Agent, or Firm*—Haseltine, Lake & Waters

[57] ABSTRACT

A process and apparatus for on-track truing of the surface of the head of rails of a railway wherein a predetermined number of truing tools, oriented along tangents to the profile of the head, are moved along generatrices of the surface and wherein the value of at least one of the parameters influencing the metal-removing capability of at least one truing tool is under the control of a control value which is preestablished as a function of the desired cutting depth of the tool. At least one magnitude value representative of the state of the rail head before truing is measured by a measuring device at the front of a truing vehicle and the control value is determined as a function of the measured value and of the known values corresponding to the metal-removing capability. The control value is adjusted according to the results obtained at the end of a rail length corresponding at least to the length of the entire assembly of truing tools utilized.

12 Claims, 4 Drawing Figures

PROCESS AND APPARATUS FOR ON-TRACK TRUING OF THE HEADS OF RAILS OF A RAILWAY

FIELD OF THE INVENTION

The present invention relates to a process for on-track truing of the head of rails of a railway and also to an apparatus to carry out the process.

BACKGROUND OF THE INVENTION

There are already known processes of the type wherein a given number of truing tools are moved along the generatrices of the surface of the head of rails, the tools being so positioned with respect to the rail section to true the surface by eliminating irregularities either initially present or resulting from wear due to stresses caused by the rolling material.

Those irregularities are mainly shaped as undulatory deformations having an amplitude and a wavelength which vary in accordance with the cause involved as well as their location around the outline of the head of the rails.

It therefore becomes necessary, at every use, to adjust the metal-removing capability of the truing tools in proportion to the variations of those deformations.

For this purpose, the value of at least one parameter acting on the metal-removing ability of a single or a group of truing tools, is brought under the control of a set control value in order to adjust the cutting depth of said tools to the actual condition of the surface. Thus, the bearing pressure, the cut speed, the inclination angle and the displacement speed of the truing along the rails are effectively controlled.

The setting of the control value assigned to those various parameters is manually performed pursuant to a personal estimate made by operators, and the quality of the grinding which is carried out according to that process still depends, on a large part, on the operator's experience and skill.

When quantitative evaluations are to be observed, a mere qualitative estimate from the operator does not suffice and it becomes necessary to control the carried-out truing by measuring their irregularities remaining on the head surface of the trued rails. Those measurements are presently gathered by means of independently controlled vehicles which supply, as they progress along the railway, a graphic record in the form of a diagram showing the running evolution of the amplitude and the wavelength of the undulatory deformations. The resulting diagtam is thereafter examined to determine the values of the residual deformations in order to establish the necessary quantitative comparison with predetermined values of acceptable deformations. Finally, based on the results of such comparison, the operators decide on carrying out a second truing operation of the same segment of rail and on the setting of new control values for the second cut.

The end result of such a process is satisfying, but it is lengthy, it requires numerous manipulations and still depends heavily on the experience of the operator.

SUMMARY OF THE INVENTION

An object of the present invention is to provide a process which avoids, to a large extent, the above inconveniences by a logical planning of the truing operation control of the rail head surface irregularities by measuring their characteristics.

To this end, the process of truing, in accordance with the invention, wherein the value of at least one of the parameters influencing the metal-removing ability of at least one truing tool is under the control of a set control value, comprises the steps of measuring the magnitude of at least one value representative of the state of the rail head before truing, such as the mean amplitude of large wavelength undulatory deformations and the amplitude of defects in the profile of said head, determining the control value as a function of the measured magnitude and a function of known values representing the metal-removing capability of the grinding tool and, adjusting, directly or indirectly, the setting of said control value according to the truing results obtained for a length of rail at least corresponding to the length being taken up by the truing tools altogether.

By proceeding this way in determining logically the control value to be set from known and measured quantitative data relative to the truing tool capability and to the surface irregularities to be eliminated, the uncertainty resulting from the manual processes mentioned above is avoided. It is then possible to fit sufficiently accurately the work of the truing tools on the irregularities encountered at the very beginning of the truing operation so as to get rid of those irregularities in a single operation or to reduce to a minimum the number of operations when the irregularities call for the removal of more material than the capability of the truing tool assembly utilized. When necessary, the setting of the control value determined in accordance with the process of the invention will be adjusted or not with regards to the results of the work done.

In an advantageous form of the process according to the invention, the adjustment of the control value is indirectly achieved as follows: after the truing of a length of rail corresponding to the length taken up by the truing tool unit, the amplitude of the residual deformations is measured, the difference between this measured value and that of the maximal amplitude permissible for said deformations is determined, and the value of that difference, eventually bearing a coefficient of proportionality experimentally determined, is added to the deformation amplitude value measured before truing.

In this manner, the djusting of the control value is also logically effected, being related to the measured and known quantitative data, which allows optimization of the truing operation.

Finally, within the scope of this truing process, it is advantageous to adjust the advance speed of the truing tools along rails by setting the control value or that speed determined from the measurements of the irregularities of the surface of the stretch of rails whereupon the greatest irregularities are detected.

The invention also contemplates an apparatus for carrying out the described process.

Such apparatus comprises in known manner at least one truing vehicle equipped with a determined number of rail-head truing tools connected to a supply and control circuit comprising a device for controlling the value of at least one parameter depending from said circuit and influencing the metal-removing capability of at least one truing tool, by means of a control which is preestablished as a function of the desired cutting depth of said tool, and a device for setting said control value. This apparatus is characterized in that it comprises, located at least at the front end of the truing vehicle, a means for measuring the known selected value representative of the state of the hed of the rails and delivering an output signal corresponding to the magnitude of said selected value, a means for setting said value, a means for setting the known values corresponding to the metal-removing capability of the tool under consideration and means for determining the control value of the selected parameter as a function of the set values.

This truing device may include one or several truing vehicles considering the amount of work to be effected.

The measuring device mounted at the front end may be made part of either a truing vehicle or an independent measuring vehicle.

The element for determining the control value may consist either of a series of preestablished graphs or a calculator integrated on the control circuit of the truing tools, depending on the degree of automatic working desired.

Those embodiments of the apparatus in accordance with the invention, as well as others permitting the carrying out of the various forms of the process, will clearly appear from the following description and the appended drawings which relate to a preferred embodiment given by way of example.

DETAILED DESCRIPTION

Figure 1:
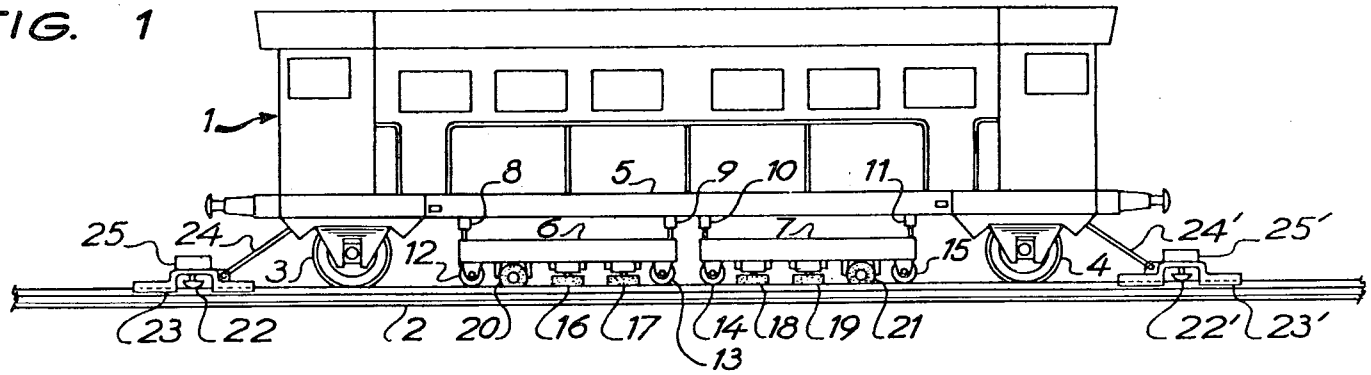
FIG. 1 is a diagrammatic side elevation view of the apparatus according to the invention.

In FIG. 1 there is seen a truing vehicle 1 travelling on the rails 2 of a railway and on which it rests by wheels 3, 4 on two axles. This vehicle is self-powered and thus equipped with a power unit which also supplies the energy necessary to energize and control the truing tools.

The tools, composed of cylindrical grinders (six in number of each stretch of rail) angularly positionable in a plane transverse to the rail, are mounted on grinding units 6 and 7 connected to the frame 5 of the vehicle by means of hydraulic jacks 8, 9, 10 and 11. In use, these units rest on the rail via rollers 12, 13, 14 and 15. Four of these tools, designated 16, 17, 18 and 19, are progressively oriented to follow the profile of the tread of the rail-head and two tools, designated 20 and 21, are oriented to follow the profile of the internal face of said head.

At the front and rear ends of the truing vehicle, there is mounted a device for measuring the amplitude of the head of the rails. This measuring device comprises, in a known manner, a set of feelers mounted side by side around the tread and the internal face of the rail head, the first one being exteriorly located and designated by 22 at the front end and 22' at the rear end. These feelers are respectively supported by runners 23 and 23', maintained in contact against the tread and the internal face of the rail heads.

The bearing surface of these runners is of such a length as to be continuously applied on at least two consecutive peaks of the undulatory deformations.

Figure 2:
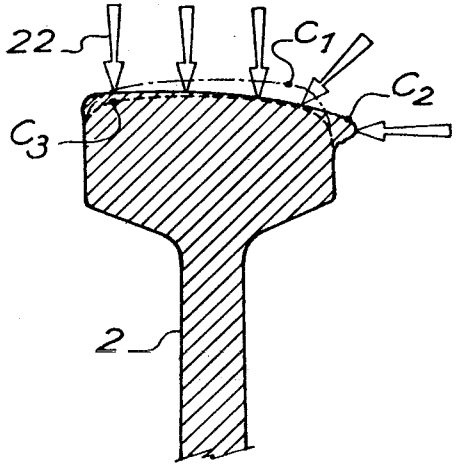
FIG. 2 shows a partial section of a worn out rail.

An example of the arrangement of the feeleers is illustrated in FIG. 2 where there is shown, in partial section, a worn-out rail 2 whose actual shape $C_2$ exhibits substantial profile defects when compared to the initial profile $C_1$. This arrangement is so chosen as to be able to feel the most representative zones about the state of the rail head, not only lengthwise to gather data on the undulatory deformations but also cross-sectionally for data on defects about the profile. In the latter case, the defects in the profile are thereafter determined by comparison with a reference profile $C_3$ which may be similar to the original profile $C_1$ or to a mean wear profile.

The relative displacements of each feeler 22 with respect to substantially vertical and horizontal planes defined by the bearing faces of the runners, are detected by measuring sensors 25 and 25', respectively, of known type, capable of delivering an output signal proportional to said relative displacements.

The feeling unit, runner and sensor of each of those two measuring devices, is connected to the grinding vehicle by telescopic stems 24 and 24', respectivey, for lifting the same upon the occurrence of gaps such as switching points, and for concealing it in the loading-gage for its off-running.

Figure 3:
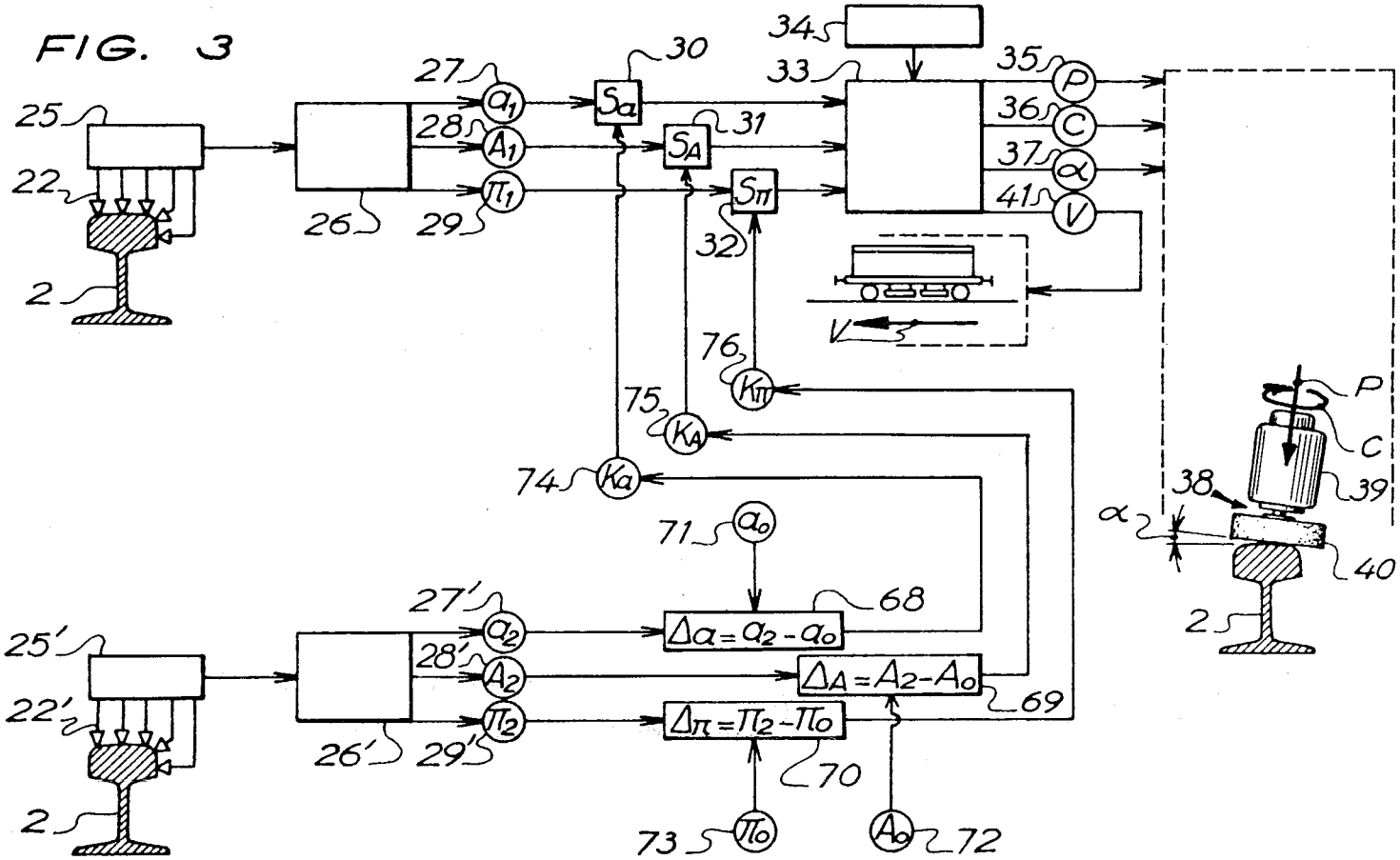
FIG. 3 is a circuit diagram for establishing a control value from a measurement taken at the front end and at the rear end of the vehicle for effecting operation of a grinding tool.

In FIG. 3 of the drawings, there is schematically shown above a cross-sectional view of rail 2, the feeler 22 together with four other feelers for the head of the rails, and also the measuring sensor 25 which delivers an output signal proportional to the displacements of each of those feelers.

These measured signals from the sensor 25 are transmitted to a processing device 26 comprising, in a known manner, integrating amplifiers and filters necessary for obtaining output signals representative of the amplitude of the measured values. These values which are: means amplitude of the undulatory deformations of short wavelength $a_1$ (of a length between 5 and 20 cm); the amplitude of undulatory deformations of long wave length $A_1$ (of a length greater than 1.5 m); and the amplitude of the defects in the rail head profile $\pi_1$, are displayed on display devices respectively designated 27, 28 and 29 in agreement with the values mentioned. These display devices are not essential for the operation of the illustrated circuit and serve here as visual control means.

The signals representative of the amplitude of the values $a_1$, $A_1$ and $\pi_1$ are transmitted either directly, or through adjusting devices 30, 31 and 32 the operation of which will be discussed later on, to a calculator 33.

A display device 34 for the known values corresponding to the metal-removing capability of the grinding tools used, is connected to the calculator 33, permits memorization of said values and is also useful for their visual control.

With the memorized values and the input signals representing the values of the amplitude $a$, $A_1$ and $\pi_1$ from the measuring device, the calculator 33 is programmed to compute, in accordance with a computation process to be described later also in the memory, output signals representing control values governing the circuits controlling the grinding tools.

These output signals are delivered to respective display devices of said control circuits, designated 35 for the value of the bearing pressure P, 36 for the cut speed C, 37 for the inclination angle $\alpha$ of the grinding tools. These various characteristics of operation of said tools are symbolically indicated in FIG. 3 where there is shown a grinding tool applied against the rail 2 with a pressure P. The motor 39 of the tool drives a grinding wheel 40 in rotation at an angular speed which is related to the selected cut speed C. This tool is oriented at an inclination angle 60 .

A fourth setting device 41 of the control value V of the forward speed of the grinding tools is connected to a circuit controlling the forward speed of the grinding vehicle 1.

These various control circuits, simply illustrated here by a box in dotted outline, are of known type comprising, for each tool or groups of tools, means for controlling the bearing pressure on the rails, the cutting speed and the inclination angle, operating through variations of the characteristics of said circuits.

Figure 4:
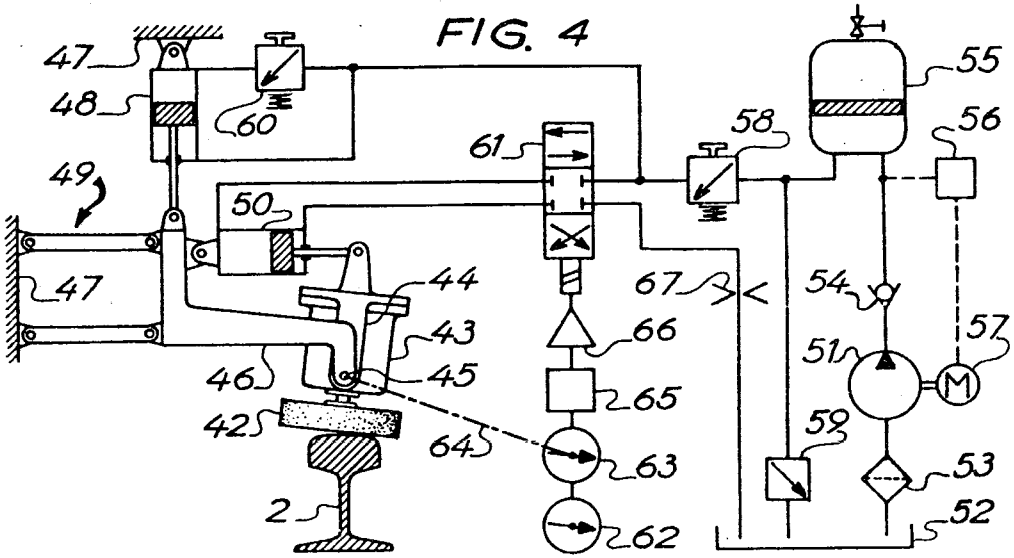
FIG. 4 is a circuit diagram for controlling the bearing pressure and the position of a grinding tool.

FIG. 4 is a diagrammatic illustration of such a control circuit, using hydraulic energy.

On rail 2, there is shown a grinding tool (similar to tool 16 illustrated in FIG. 1) comprising a grinder or stone 42 driven in rotation by an electric motor 43 of the synchronous type having a substantially constant rotation speed. The motor is mounted on a housing 44 pivotably set around an axis 45 born by a support member 46. The support 46 is connected to the frame 47 of the grinding unit by a double-action suspension type hydraulic jack 48 and by an articulated parallelogram system 49 allowing vertical oscillations of the grinding tool without varying its work angle.

The upper extremity of the housing 44 of the grinding tool is connected to the support 46 through a double-action hydraulic jack 50.

The hydraulic jack 48 is useful in regulating the bearing pressure of the grinding tool and the inclination angle of hydraulic jack 50. The two jacks are fed by a hydraulic circuit comprising a constant capacity hydraulic pump 51 drawing the fluid from a tank 52 through a filter 53 and feeding it into a hydraulic accumulator 55 provided with a separator piston and gas under pressure through a check valve 54. A pressurestat 56 is coupled to the feed circuit of the accumulator and is connected to the electric motor 57 driving the pump 51 to actuate it or stop it within predetermined accumulator pressure limits. The output pressure $P_1$ of this circuit is adjusted by means of a pressure regulating valve 58. A discharge valve 59 is provided with return to the tank as a safe-guard in case of circuit overload or failure of the pressurestat 56.

A first branch of this base circuit feeds the two chambers of the grinding tool suspension jack 48. The lower chamber of this jack is directly fed under the pressure $P_1$ controlled by the pressure regulating valve 58 and the upper chamber is fed under a pressure $P_2$ different from $P_1$ by means of a second pressure regulating valve 60 inserted in the feed piping for said upper chamber.

The bearing pressure of the grinding tool is dependent on the difference between the pressures $P_1$ and $P_2$ acting on the opposed surfaces of the piston of the hydraulic jack, the desired value P of the bearing pressure being determined through the setting of the value corresponding to the pressure $P_2$ on the pressure regulating valve 60.

A second branch of the base hydraulic circuit feeds the two chambers of the jack 50, for the orientation of the grinding tool. An electrically controlled hydraulic valve 61 is provided in this branch to direct the fluid under pressure in one or the other of the two chambers of said jack 50 until the correct inclination angle of the grinding tool is achieved, corresponding to the neutral position illustrated.

The controlled valve 61 is governed by an electric circuit comprising a synchro-emitter 62 constituting the setting device of the desired inclination angle $\alpha$ of the grinding tool, a synchro-receiver 63 driven to a suitable extent by the grinding tool housing 44 by means of an appropriate mechanical link 64 mounted on the axis 45, a filter 65 and amplifier 66. In this control circuit, the synchro-receiver 63 generates an output signal representative of the direction and magnitude of the difference existing between the desired angular position of the tool set on the synchro-emitter 62 and the actual position of said tool transmitted to the synchro-receiver 63. This signal, filtered and amplified, actuates the controlled valve 61 in the required direction until said difference is cancelled. A throttle 67 is inserted in the return path of the controlled valve 61 to the tank to limit the displacement speed of the fluid under pressure in this second circuit.

The circuit for determining the control values for the truing vehicle in FIG. 1, adjustable as a function of the measure of the amplitude of the irregularities of the rail heads before grinding, in this preferred embodiment of the device in accordance with the invention, is constituted by a circuit for correcting control values determined from the measurements taken at the front end, as a function of the magnitude of the residual amplitude of the irregularities of the rail heads after grinding.

In FIG. 3, which schematically represents this correcting circuit, the same numerical references have been used to designate the elements constituting the rear measuring device as in FIG. 1, but to which a prime sign has been added. These elements: feelers, sensor, processing device and adjusting devices have the same functions as those already described in connection with FIG. 1.

The output signals from the rear measuring device, representative of the residual amplitude ($a_2$, $A_2$ and $\pi_2$) of the same values measured at the front end of the grinding vehicle, are each directed to a comparator element designated 68 for the signal $a_2$, 69 for the signal $A_2$ and 70 for the signal $\pi_2$.

To each of these comparator elements, there is also connected a device for controlling the maximum acceptable amplitude values ($a_0$, $A_0$ and $\pi_0$) of said values which are considered or deemed acceptable for the ground rail section: the control devices 71 for the value $a_0$, 72 for $A_0$ and 73 for $\pi_0$.

Each comparator element is arranged to deliver an output signal representative of the algebric value of the difference between the input values mentioned before.

These output signals, representative of the difference values: $\Delta_a = a_2 - a_0$, $\Delta_A = A_2 - A_0$ and $\Delta_\pi = \pi_2 - \pi_0$, are each directed to an adjusting device connected to the output circuit of the front measuring device corresponding to the same measured value. For this purpose, the comparator element 68 is connected to the adjusting device 30, the comparator element 69 is connected to the adjusting device 31 and the comparator element 70 is connected to the adjusting device 32.

The adjusting devices are arranged to deliver output signals representative of the algebric addition ($S_a$, $S_A$ and $S_\pi$) of the above-mentioned input signals representative of the amplitude of the measured irregularities before grinding and of the difference values between the residual amplitude and the maximum acceptable amplitude of said irregularities, according to the formulas:

$S_a = a_1 + \Delta_a$, $S_A = A_1 + \Delta_A$ and $S_\pi = \pi_1 + \Delta_\pi$

Finally, in each one of the circuits interconnecting a adjusting device with a comparator element, there is a device for setting the proportionality coefficients $K_a$, $K_A$ and $K_\pi$, respectively which are experimentally determined. This adjusting device, designated 74 for the value *a*, 75 for the value A and 76 for the value $\pi$, constitutes an optional means for the fine adjustment of the difference value transmitted.

Modifications could be made in the embodiment of this device without departing from the gist of the process according to this invention.

In particular, the element for determining the control values, here the calculator 33, may be replced in a less sophisticated modification by experimentally preestablished diagrams giving relations between the cutting depth of the grinding tools and the known characteristics relative to the metal-removing capability of the tools under consideration.

In this case, it is the operator who gets the control values P, C, V and $\alpha$, which correspond, on the diagrams, to the values measured and displayed on the display devices 27, 28 and 29, optionally adjusted by the adjusting devices 30, 31 and 32 which would then also comprise a display device on the adjusted value.

Finally, the invention is not restricted to the use of rotating tools such as grinders or drills, but it applies as well, within modifications compatible with their material-removing capabilities, to non-rotating maching tools, such as, for example, abrasion blocks, wear shoes, electro-abrasion tools and the like.

What is claimed is:

1. In a process for on-track truing of the surface of the head of rails of a railway wherein a predetermined number of truing tools, oriented along tangents to the profile of said head, are moved along the genratrices of said surface, and wherein the value of at least one of the parameters influencing the metal-removing capability of at least one truing tool is under the control of a control value which is pre-established as a function of the desired cutting depth of said tool, the improvement comprising measuring at least one magnitude value representative of the state of the rail head before truing, determining the control value to be set in order to effect at least one of (a) the desired cutting depth of said tool, (b) the position of said tool as a function of the measured value of said magnitude and of the known values corresponding to its metal-removing capability; and adjusting the setting of said control value according to the results obtained at the end of a rail length corresponding at least to the length of the entire assembly or truing tools utilized.

2. A truing process as claimed in claim 1, wherein the control value is indirectly adjusted by the steps of measuring, after the truing of the length of rail corresponding to the length of the assembly of the tools utilized, a magnitude value selected as representative of the state of the rail head, computing the difference between this measured value and a value of maximum acceptable amplitude of said magnitude value; and adding the value of this difference to the magnitude value representative of the state of the rail head.

3. A truing process according to claim 2 wherein the displacement speed along the rail of at least one truing tool is under the control of a control value, said control value being determined from measurements of at least one of (a) amplitude of the undulatory deformations, (b) defects in the profile of the head of rails affected with the largest ones of those defects and deformations.

4. A truing process according to claim 1 wherein said magnitude value representative of the state of the rail head before truing is at least one of the mean amplitude ($a_1$) of an undulatory deformation of short wavelength, a mean amplitude ($A_1$) of an undulatory deformation of long wavelength, and a mean amplitude ($\pi_1$) of defects in the profile of the rail head.

5. A truing process according to claim 1 wherein the parameter influencing the metal-removing capability of at least one truing tool is at least one of its bearing pressure (P), its cutting speed (C) its inclination angle ($\alpha$) and its speed of displacement along the rail (V).

6. A truing process according to claim 2 wherein the magnitude value selected as representative of the state of the rail head is at least one of the mean residual amplitude ($a_2$) of the undulatory deformations of short wavelength, the mean residual amplitude ($A_2$) of undulatory deformations of long wavelength, and the mean residual amplitude ($\pi_2$) of defects in the profile of the head.

7. In apparatus for on-track truing of the surface of the head of rails of a railway comprising at least one grinding vehicle including a pre-determined number of tools for truing the head of the rails, a feed and control circuit connected to said tools and comprising means for controlling the value of at least one parameter depending from said circuit and influencing the metal-removing capability of at least one truing tool according to a control value which is preestablished as a function of the desired cutting depth of said tool, and means for setting said control value, the improvement comprising means positioned in front of the truing vehicle for measuring at least one of (a) the mean amplitude ($a_1$) of undulatory deformations of short wavelength, (b) the amplitude ($A_1$) of undulatory deformations of long wavelength, and (C) the amplitude ($\pi_1$) of defects in the profile of the head of the rails and for generating an output signal representative of the value of said amplitude, means for setting said value of the amplitude, and means for setting known values corresponding to the metal-removing capability of the tool in question, the control value of the selected parameter to obtain the cutting depth desired and/or the position of said tool being determined as a function of the value of the amplitude set and of the metal-removing capability values set.

8. A device according to claim 7 wherein the measuring means is mounted on a measuring vehicle supported from the truing vehicle and in front thereof.

9. A device according to claim 7 wherein at least one truing vehicle is equipped with at least one measuring device.

10. A device according to claim 9 comprising a measuring device mounted at the rear end of the last truing vehicle for generating an output signal representative of at ldast one of (a) the mean residual amplitude ($a_2$) of the undulatory deformations of short wavelength, (b) the residual amplitude ($A_2$) of the undulatory deformations of long wavelength, and (c) the residual amplitude ($\pi_2$) of defects in the profile of the head of the rails, means for setting the value of said residual amplitude, means for setting the value of the acceptable amplitude of said deformations and defects at least one of $a_0$, $A_0$, and $\pi_0$), comparator means for generating an output signal representative of the algebric value of the difference between said residual amplitude value and said acceptable amplitude value (at least one of $\Delta_a$, $\Delta_A$, and $\Delta_\pi$), adjusting means connected to said comparator means and to the output of said measuring device mounted at the front end of the first grinding vehicle for adjusting the value of the amplitude of the deformations and defects of the head of the rails before the truing (at least one of $a_1$, $A_1$ and $\pi_1$) by adding said value with that of said difference value ($S_a = a_1 + \Delta_a$ and/or $S_A = A_1 + \Delta_A$ and/or $S_\pi = \pi_1 + \Delta_\pi$).

11. A device according to claim 10 comprising means connected in the circuit path coupling the comparator means to the adjusting means for setting a proportionality coefficient (at least one of $K_a$, $K_A$, and $K_\pi$) which is experimentally determined.

12. A device according to claim 7 wherein the control value of the parameter selected so as to obtain the cuttinb depth desired and/or the position of at least one truing tool is obtained by means of a calculator generating an output signal representative of said control value in which said signal is computed, in accordance with a memorized computation process, from the output signal of the device for measuring the amplitude of the deformations, (at least one of $a_1$, $A_1$ and $\pi_1$) of the head of the raills and from the set values corresponding to the metal-removing capability of the truing tool under consideration.

* * * * *